US011424047B2

(12) United States Patent
Oh et al.

(10) Patent No.: US 11,424,047 B2
(45) Date of Patent: Aug. 23, 2022

(54) METHOD OF PRODUCING ACTINIUM BY IRRADIATING LIQUEFIED RADIUM WITH A PARTICLE BEAM

(71) Applicant: KOREA INSTITUTE OF RADIOLOGICAL & MEDICAL SCIENCES, Seoul (KR)

(72) Inventors: Se Young Oh, Seoul (KR); Sang Moo Lim, Seoul (KR); Kyo Chul Lee, Seoul (KR); Joo Hyun Kang, Seoul (KR)

(73) Assignee: KOREA INSTITUTE OF RADIOLOGICAL & MEDICAL SCIENCES, Seoul (KR)

( * ) Notice: Subject to any disclaimer, the term of this patent is extended or adjusted under 35 U.S.C. 154(b) by 168 days.

(21) Appl. No.: 16/917,286

(22) Filed: Jun. 30, 2020

(65) Prior Publication Data

US 2021/0027906 A1 Jan. 28, 2021

(30) Foreign Application Priority Data

Jul. 23, 2019 (KR) ..... 10-2019-0089190

(51) Int. Cl.
*G21G 1/10* (2006.01)
*G21G 1/00* (2006.01)
(Continued)

(52) U.S. Cl.
CPC ..... *G21G 1/10* (2013.01); *G21G 1/001* (2013.01); *G21G 1/0005* (2013.01); *G21G 1/06* (2013.01);
(Continued)

(58) Field of Classification Search
CPC .. G21G 1/10; G21G 2001/0089; G21G 1/001; G21G 4/08
(Continued)

(56) References Cited

U.S. PATENT DOCUMENTS 5,038,046 A 8/1991 Norman et al.
6,299,666 B1 10/2001 Apostolidis et al.
(Continued)

FOREIGN PATENT DOCUMENTS

EP 0752709 A1 1/1997
EP 0962942 A1 12/1999
(Continued)

OTHER PUBLICATIONS

"Development of Actinium-225 Production Method using Liquid Targe", 11th International Symposium on Targeted Alpha Therapy, 2019, Proceedings from the TAT11/Journal of Medical Imaging and Radiation Sciences 50 (2019) S1-S42, Fairmont Château Laurier, Ottawa, ON Canada.

*Primary Examiner* — Jack W Keith
*Assistant Examiner* — Daniel Wasil

(57) ABSTRACT

A method of producing actinium by using liquefied radium includes producing Ac-225 using Ra-226 of a liquefied state, moving the produced Ac-225 in a liquefied state after Ac-225 is produced, and separating Ac-225 and reusing Ra-226. As a result, a nuclear reaction process of Ac-225 may be performed and loss of Ra-226 may be minimized. Further, such a method may improve safety by including a radon collection unit which is capable of discharging and isolating radon produced from Ra-226, thereby preventing radiation exposure due to radon.

14 Claims, 10 Drawing Sheets

(51) Int. Cl.
*G21G 1/06* (2006.01)
*G21G 4/08* (2006.01)

(52) U.S. Cl.
CPC ..... *G21G 4/08* (2013.01); *G21G 2001/0089* (2013.01)

(58) Field of Classification Search
USPC ..... 376/194, 195
See application file for complete search history.

(56) References Cited

U.S. PATENT DOCUMENTS

| | | | | |
|---|---|---|---|---|
| 6,680,993 | B2 | 1/2004 | Satz et al. | |
| 2002/0094056 | A1 | 7/2002 | Satz et al. | |
| 2007/0153954 | A1* | 7/2007 | Harfensteller | G21G 1/10 376/194 |
| 2007/0297554 | A1 | 12/2007 | Lavie et al. | |
| 2009/0191122 | A1 | 7/2009 | Moreno Bermudez et al. | |
| 2017/0004897 | A1 | 1/2017 | Eriksson et al. | |
| 2017/0137916 | A1* | 5/2017 | Moreno Bermudez | G21G 4/08 |
| 2018/0322972 | A1* | 11/2018 | Pärnaste | G21G 1/10 |

FOREIGN PATENT DOCUMENTS

| | | | | |
|---|---|---|---|---|
| EP | 0962942 | B1 | 4/2003 | |
| EP | 1599882 | B1 | 12/2006 | |
| JP | H05264794 | A | 10/1993 | |
| JP | 2007508531 | A | 4/2007 | |
| JP | 2007536533 | A | 12/2007 | |
| JP | 2009527731 | A | 7/2009 | |
| JP | 2014196997 | A | 10/2014 | |
| JP | 2018519517 | A | 7/2018 | |
| JP | 2018190711 | A | 11/2018 | |
| WO | WO-2020260210 | A1 * | 12/2020 | G21G 1/10 |

* cited by examiner

METHOD OF PRODUCING ACTINIUM BY IRRADIATING LIQUEFIED RADIUM WITH A PARTICLE BEAM

CROSS-REFERENCE TO RELATED APPLICATIONS

Priority to Korean patent application number 10-2019-0089190 filed on Jul. 23, 2019 the entire disclosure of which is incorporated by reference herein, is claimed.

FIELD OF THE INVENTION

The present disclosure relates to a method of producing actinium by using liquefied radium and, more specifically, to a production method capable of producing actinium by performing a nuclear reaction of liquefied radium.

BACKGROUND OF THE INVENTION

Ac-225 is produced while two neutrons are escaping from the radium-226 target material when accelerating and colliding a proton with a radium-226 target material by a nuclear reaction of 226Ra(p, 2n)225Ac to produce actinium-225, i.e., a radioactive medicine for treatment. A Ra-226 material used at this time generally includes a powder-type target among solid targets. A Ra-226 powder to which the proton has been irradiated passes through a series of separation and refinement processes in order to separate Ac-225 which is included in the powder and has been produced by performing a nuclear reaction. To this end, a method of producing Ac-225 may comprise melting Ra-226 into a liquefied form, passing a liquefied Ra-226 through separation and refinement processes, and performing a process of preparing the powder type Ra-226 to reuse a powder type Ra-226 for producing Ac-225 again. A method of producing Ac-225 by using such a powder type Ra-226 is disclosed in U.S. Pat. No. 6,680,993.

However, such a conventional technique makes a quantitative loss of Ra-226 according as Ra-226 is changed into a powder form and a liquefied form in a series of processes for producing Ac-225. Due to problems that Ra-226 has a long half-life of about 1,600 years at present, and releases radon, i.e., an inert gas in the decay process, there have been difficulties in disposal and storage of Ra-226, and, for this reason, additional production has been suspended. Therefore, it is desirable that a loss of Ra-226 is minimized in the process of producing Ac-225 by using Ra-226 which has not been left much in the world.

SUMMARY OF THE INVENTION

The purpose of the present disclosure is to provide a method of producing actinium using liquefied radium, the method for minimizing loss of Ra-226 which may be generated in the process of producing Ac-225 by performing a nuclear reaction using conventional Ra-226.

To achieve the purpose, the present disclosure may provide a method of producing actinium by using liquefied radium, the method comprising a step of moving the liquefied radium to load the liquefied radium into a reaction space inside a chamber, a step of producing actinium through a nuclear reaction process by irradiating a particle beam to the liquefied radium of the reaction space inside the chamber, and an unloading step of moving a product comprising the liquefied radium and actinium to the outside of the chamber.

Meanwhile, the method of producing actinium using liquefied radium may further comprise a separation step of separating actinium from the product.

Further, the method of producing actinium using liquefied radium may comprise a reloading step of moving remaining liquefied radium obtained by separating actinium from the product to the reaction space of the chamber.

Moreover, the method of producing actinium using liquefied radium may further comprise a radon discharge step of discharging radon included in the product while performing the loading step or the unloading step.

Further, the radon discharge step enables radon to be discarded by condensing radon.

Additionally, the radon discharge step enables radon to be discharged after diluting radon with external air.

Meanwhile, the loading step enables a preset amount of radium to be moved to the reaction space.

Moreover, the loading step enables the preset amount of radium to be moved to the reaction space by using a syringe pump.

On the other hand, the unloading step enables the product to be unloaded by flowing in an inert gas into the reaction space of the chamber.

Meanwhile, the radium can be liquefied by using an organic solution.

Moreover, the organic solution may be $NO_3$ or $Cl_2$.

Moreover, the method of producing actinium using liquefied radium may further comprise a step of refining separated actinium, the step which is performed after the step of separating actinium.

A method of producing actinium by using liquefied radium according to the present disclosure can minimize loss of Ra-226 according to the state change of Ac-225 by producing Ac-225 using Ra-226 of a liquefied state, moving the produced Ac-225 in a liquefied state after Ac-225 is produced, and separating Ac-225 and reusing Ra-226 thereby enabling a nuclear reaction process of Ac-225 to be performed.

Further, a method of producing actinium by using liquefied radium according to the present disclosure has an effect of enabling safety to be improved by including a radon collection unit which is capable of discharging and isolating radon produced from Ra-226, thereby preventing radiation exposure due to radon.

DESCRIPTION OF EXEMPLARY EMBODIMENTS

Hereinafter, a method of producing actinium by using liquefied radium according to an embodiment of the present disclosure will be described in detail with reference to the accompanying drawings. Names of respective elements in the description of the following embodiments can be referred to as other names in the art. However, if there are functional similarities and identities in the elements, the elements can be said to have equivalent configurations although modified embodiments are adopted. Further, marks added to the respective elements are described for convenience of explanation. However, illustration contents on drawings having these marks described thereon do not limit the respective elements to the scope within the drawings. Similarly, if there are functional similarities and identities in the elements although partially modified embodiments adopt configurations on the drawings, the elements can be said to have equivalent configurations. Further, when the elements are recognized as elements which should be naturally included by looking at a general technician level of the field of the art, the explanations thereof are omitted.

Figure 1:
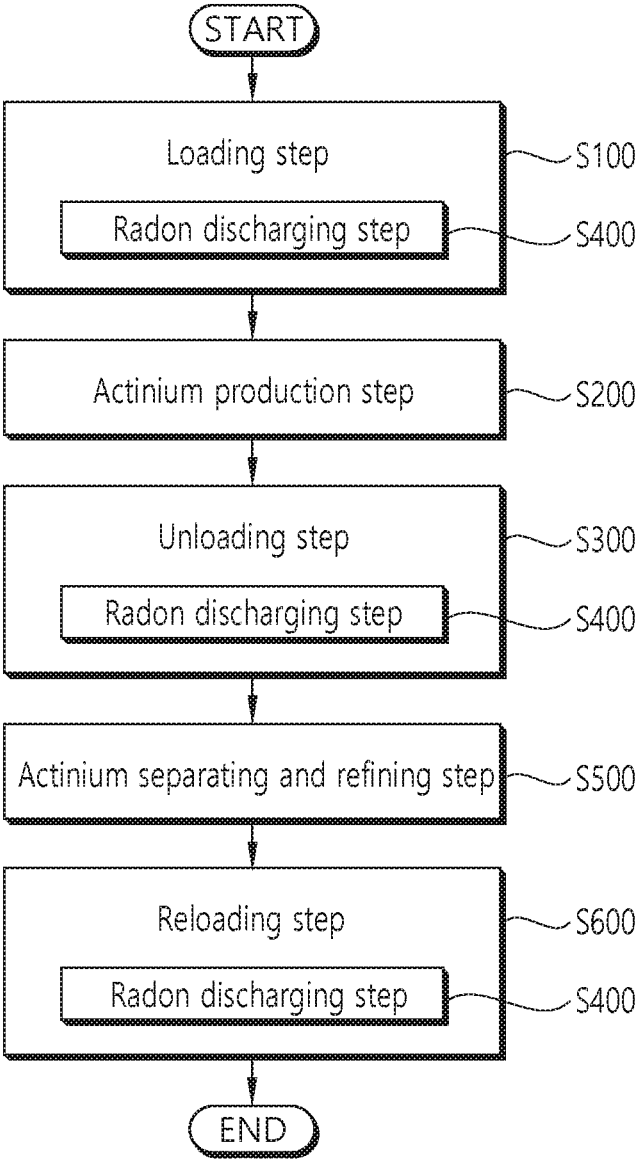
FIG. 1 is a flowchart of a method of producing actinium by using liquefied radium, i.e., an embodiment according to the present disclosure.

FIG. 1 is a flowchart of a method of producing actinium by using liquefied radium, i.e., an embodiment according to the present disclosure. As illustrated in FIG. 1, a method of producing actinium by using liquefied radium according to the present disclosure may comprise a loading step (S100), an actinium production step (S200), an unloading step (S300), a radon discharging step (S400), and an actinium separating and refining step (S500), and a reloading step (S600).

The loading step (S100) corresponds to a step of moving liquefied radium to a reaction space inside a chamber. Here, radium may be liquefied using an organic solution, and, for example, radium may be moved in a liquefied state in which ions such as $Cl_2$ or $NO_3$ are bonded. The loading step (S100) may be performed by a method of moving the liquefied radium to the reaction space by applying a pressure to liquefied radium outside the chamber. For example, a syringe pump may be provided such that a predetermined amount of the liquefied radium can be moved in a repeated loading step (S100). Meanwhile, the radon discharging step (S400) may be simultaneously performed in the loading step (S100). The radon discharging step (S400) corresponds to a step of transferring the separated radon to a separate space by separating from a product radon, i.e., a radioactive gas generated while radium is being decayed. Radon is consistently generated while radium is being naturally decayed, and radon may be naturally discharged from a vial in the process of transferring liquefied radium or liquefied product.

For example, the radon discharging step (S400) may be performed by ventilating a gas only from a vial. When transferring liquefied radium through a flow path of one side by using a syringe pump specifically in the loading step (S100), gas existing inside the flow path and chamber is moved to a vial through a flow path of the other side, gas including radon is discharged from the vial through a flow path connected to one side of the vial, and then a radon disposal step such as collection of radon may be performed.

The radon disposal step enables the volume-reduced radon to be disposed as radioactive waste after reducing volume of radon by condensing radon from a gas discharged at an extremely low temperature. Further, since a half-life of radon is turned out to be 3.82 days, the radon gas may be discharged to the outside when radioactivity of the radon gas is weakened to a reference numerical value or less measured by radiometry after several cycles of the half-life by storing a radon gas for a predetermined time, or the radon gas may be discharged to the outside by diluting the radon gas with a sufficient amount of air.

The actinium production step (S200) corresponds to a step of irradiating a particle beam accelerated from a particle accelerator to a reaction space inside the chamber when loading of liquefied radium is completed within a chamber. The actinium production step (S200) may be performed by adjusting energy or flux of the particle beam considering overall performance of an apparatus including volume of the liquefied radium inside the chamber, irradiation areas of beams, cooling performance of the chamber, pressure within the chamber, and others.

When a particle beam is irradiated, a p,2n nuclear reaction occurs in Ra-226 of a liquefied state, and Ac-225 is generated. Although the particle beam is irradiated to produce actinium within the reaction space, all of Ra-226 of a liquefied state is not entirely subjected to a nuclear reaction process, but only some of Ra-226 of a liquefied state is subjected to the nuclear reaction process and converted into Ac-225.

The unloading step (S300) is performed to discharge a liquefied product from the chamber when the nuclear reaction process is completed. For example, the unloading step (S300) may comprise discharging liquefied radium and liquefied actinium, i.e., a product to the outside of the chamber by blowing an inert gas such as He gas that is a Group 18 element into the reaction space. The aforementioned radon discharging step (S400) may be performed even in the unloading step (S300). The gas may be naturally discharged in the process of transferring the liquefied radium to the vial by blowing liquefied radium into a vial with the inert gas. Specifically, when blowing the He gas, i.e., the inert gas into the chamber such that a liquefied product can be moved, the liquefied product is transferred to the vial through a flow path connected to one side of the chamber, and a gas containing radon is discharged to the outside of the vial in response thereto.

The aforementioned radon discharging step (S400) corresponds to a step of discharging radon, i.e., a radioactive gas generated while radium is being decayed. While radium is being naturally decayed, radon is consistently generated, and these processes can be performed several times in the overall production process. The radon discharging step (S400) may comprise enabling the liquid radium or liquid product to be discharged to the outside of the vial by the generation of a pressure difference in the process of transferring a liquid radium or liquid product.

The actinium separating and refining step (S500) corresponds to a step of separating and refining actinium in a radon-separated product. The actinium separating and refining step (S500) may be performed after transferring actinium from the vial to a space for separating and refining actinium, e.g., a space such as a glove box or hot-cell. The separation of actinium is performed by separating liquefied actinium and liquefied radium. The refinement of actinium is a step of refining the separated-liquefied actinium such that the refined-liquefied actinium can be used for medical purposes. Since separated actinium contains other impurities, high purity actinium can be produced by removing the impurities.

The reloading step (S600) corresponds to a step of loading the pure liquefied radium again after moving a residual material obtained by separating liquefied actinium from a product, i.e., pure liquefied radium to a chamber such that the pure liquefied radium can be used again in the nuclear reaction process. The reloading step (S600) also can be performed by moving a fixed quantity of the pure liquefied radium to the chamber by using a syringe pump in the same manner as in the loading step (S100), or can be performed by flowing helium.

Meanwhile, although a step has not been expressed as a separate step, the step may comprise enabling the separated-liquefied radium to be disposed in a pure liquefied radium state by removing impurities from the separated-liquefied radium before reloading separated-liquefied radium in the chamber. Further, the separated-liquefied radium with an increased volume can be concentrated by a solution which is added in the process of separating actinium and radium.

A method of producing actinium by using liquefied radium 1 according to the present disclosure as described above enables pure liquefied radium to be used again in the nuclear reaction process after separating actinium produced after performing a nuclear reaction process using radium of a liquefied state.

On the other hand, although it has not been described above, a beam line connected to a chamber 100 can be maintained in a vacuum state, and the chamber 100 can be isolated from the beam line such that a liquefied target can be moved independently from the beam line in a reaction space 110 within the chamber 100. The chamber 100 includes a foil 101 which is formed of a metallic material in an irradiation path of a particle beam 10 to isolate the chamber 100 from the beam line, and the foil 101 may be formed to seal each of the beam line and the chamber 100. Meanwhile, since heat is generated when the particle beam 10 is irradiated if the foil 101 seals respective opening portions of the beam line and the chamber 100 in a connection part of the beam line and the chamber 100, a separate cooling unit for cooling the connection part of the beam line and the chamber 100 may be provided. However, since such a configuration is a configuration which is generally used in an apparatus for producing a radioactive material by using a liquefied target, a more detailed description thereof will be omitted.

Figure 2:
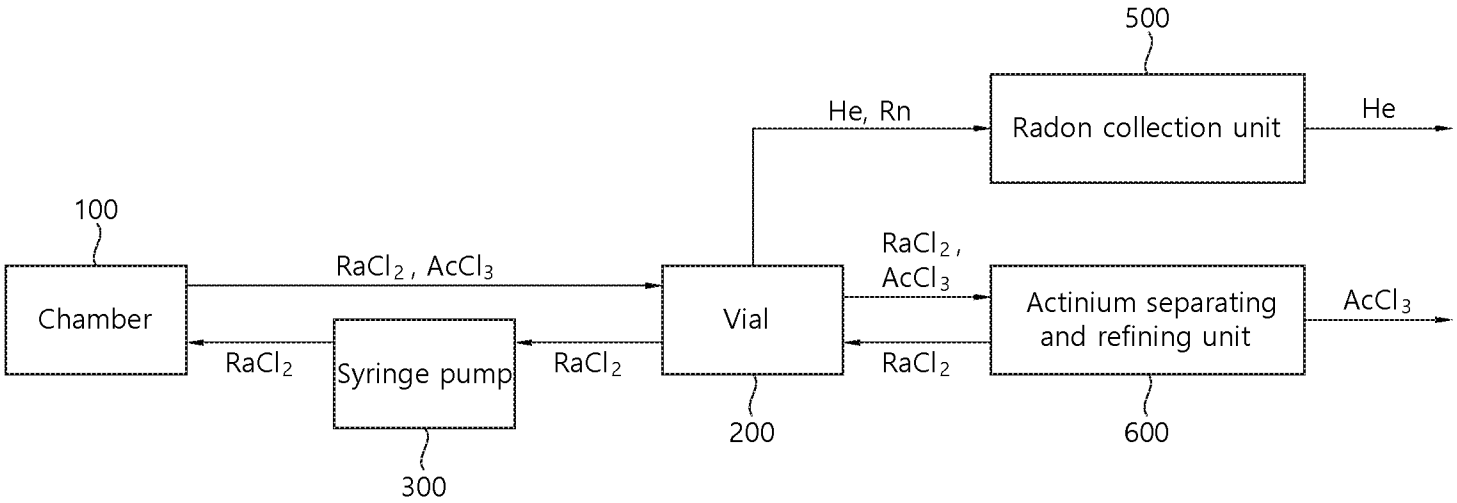
FIG. 2 is a block diagram illustrating a concept of an actinium production apparatus in which an actinium production method according to the present disclosure is performed.
Figure 3:
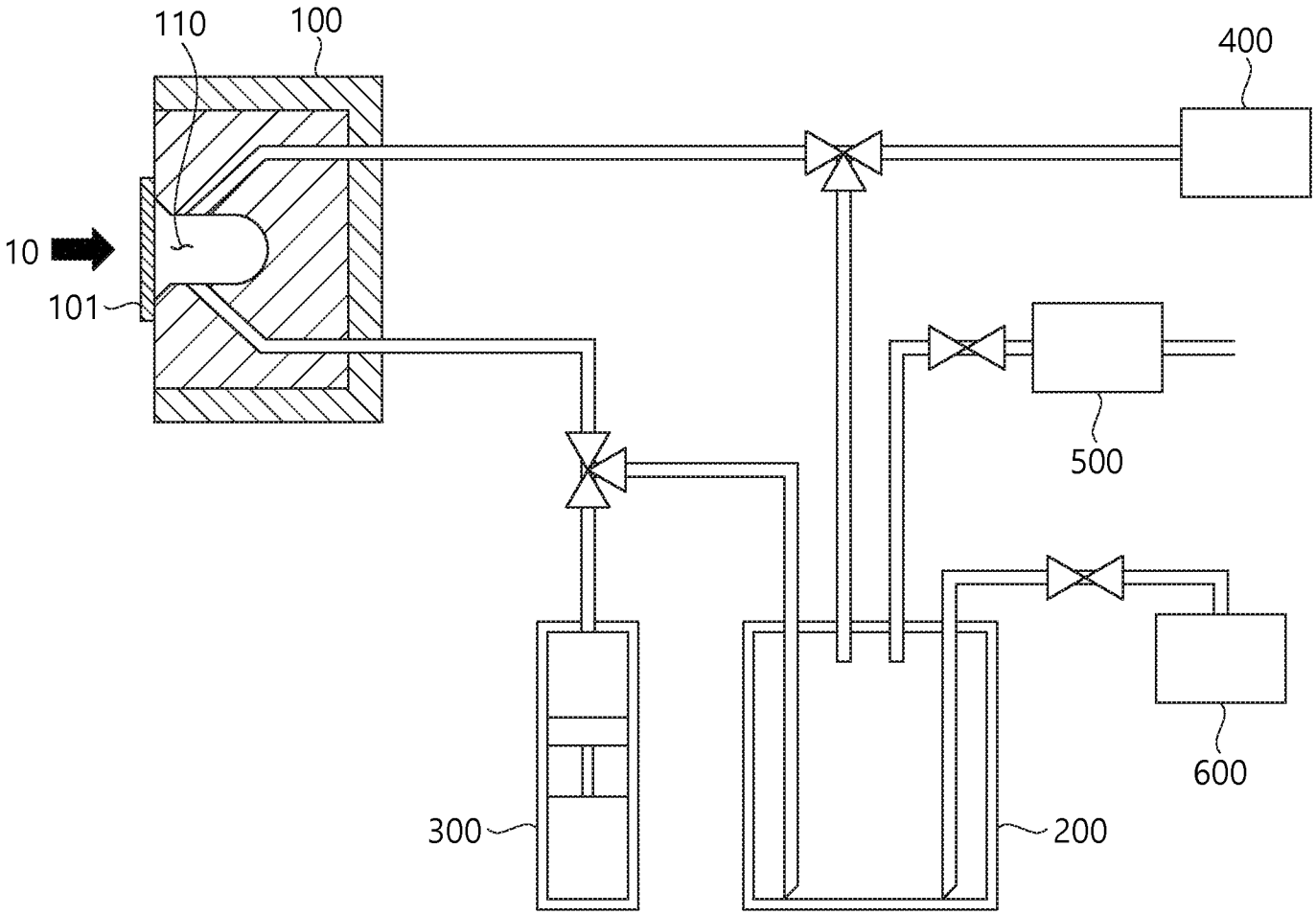
FIG. 3 is an embodiment in which the configuration of FIG. 2 is embodied.

FIG. 2 is a block diagram illustrating a concept of an actinium production apparatus in which an actinium production method according to the present disclosure is performed. FIG. 3 is an embodiment in which the configuration of FIG. 2 is embodied. As illustrated, a method of producing actinium by using liquefied radium according to the present disclosure may be performed by using an actinium production apparatus including a chamber 100, a syringe pump 300, a vial 200, a radon collection unit 500, a helium source 400, and an actinium separating and refining unit 600.

As described above, the vial 200 is a space for temporarily loading liquefied radium 1 and a nuclear reaction product, and the liquefied radium 1 may be moved from the vial 200 to the chamber 100 through the syringe pump 300. After a nuclear reaction process is performed in the chamber 100, the liquefied radium 1 and liquefied actinium 2 are moved to the vial 200. A gas is discharged from one side of the vial 200 to maintain pressure according as the syringe pump is operated, or a helium gas is supplied. The discharged gas is moved through a separate flow path, and radon can be collected or condensed while the discharged gas is passing through the radon collection unit 500. Specifically, when pressure in a flow path is increased by the operation of the syringe pump 300 or the helium source 400 in a loading process or an unloading process, gas is finally discharged from one side of the vial 200. The discharged gas can be moved to the radon collection unit 500 through the flow path.

As a product produced by performing a nuclear reaction process is transferred to the actinium separating and refining unit 600, the liquefied actinium 2 and the liquefied radium 1 are separated from each other in the actinium separating and refining unit 600. After refining the separated-liquefied actinium 2 in an actinium refinement unit 700, passing the separated-liquefied radium 1 through a refinement process, and moving the separated-liquefied radium 1 passing through the refinement process to the vial 200 again, a nuclear reaction process is prepared. Meanwhile, for example, although radium chloride ($RaCl_2$) as the liquefied radium 1 and actinium chloride ($AcCl_3$) as the liquefied actinium 2 have been described with illustration in the present embodiment, this is an example only, and actinium liquefied using various organic liquids may be used.

Hereinafter, performing a method of producing actinium by using liquefied radium 1 according to the present disclosure will be described in detail with reference to FIG. 4 to FIG. 10.

Figure 4:
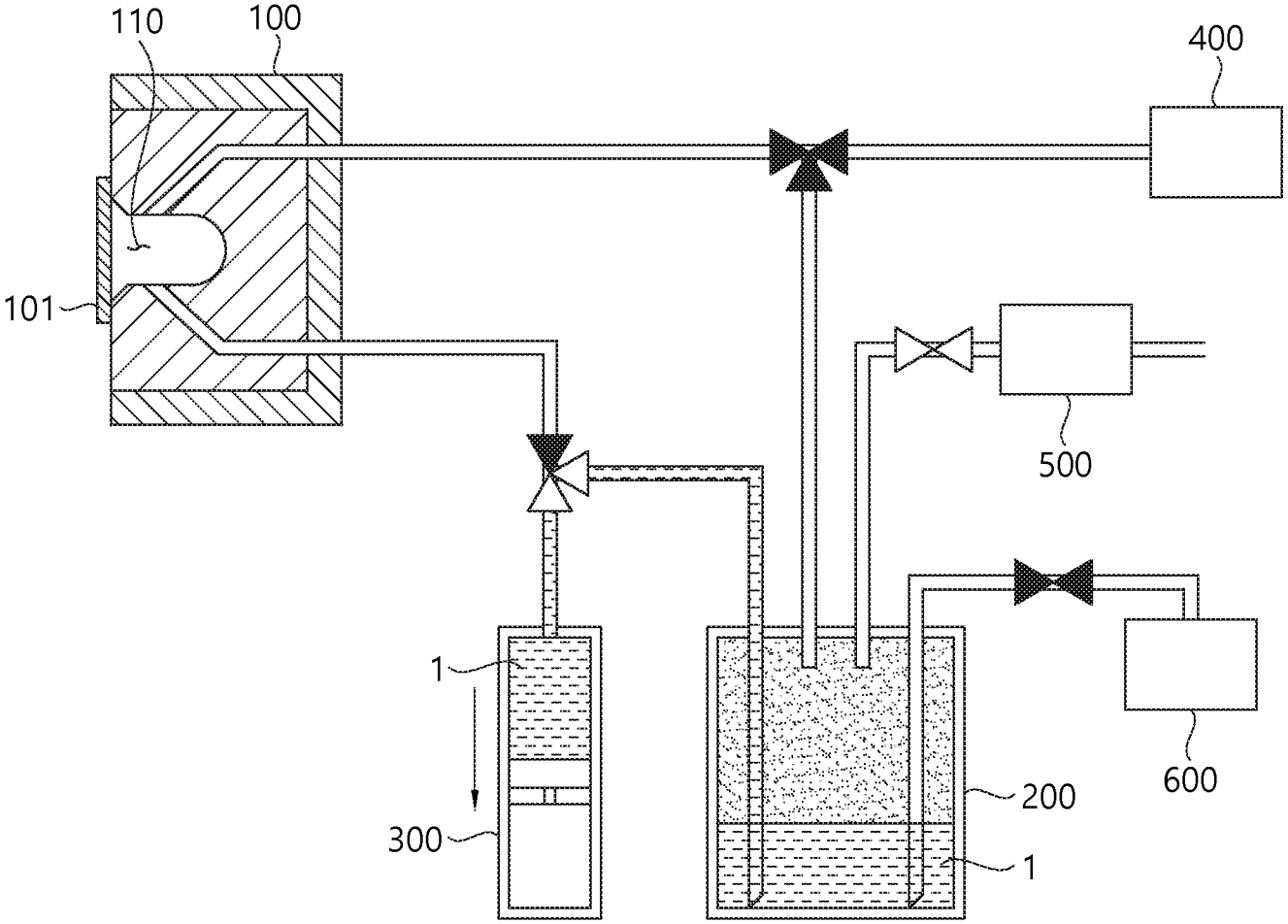
FIG. 4 is a conceptual diagram illustrating a loading step.
Figure 5:
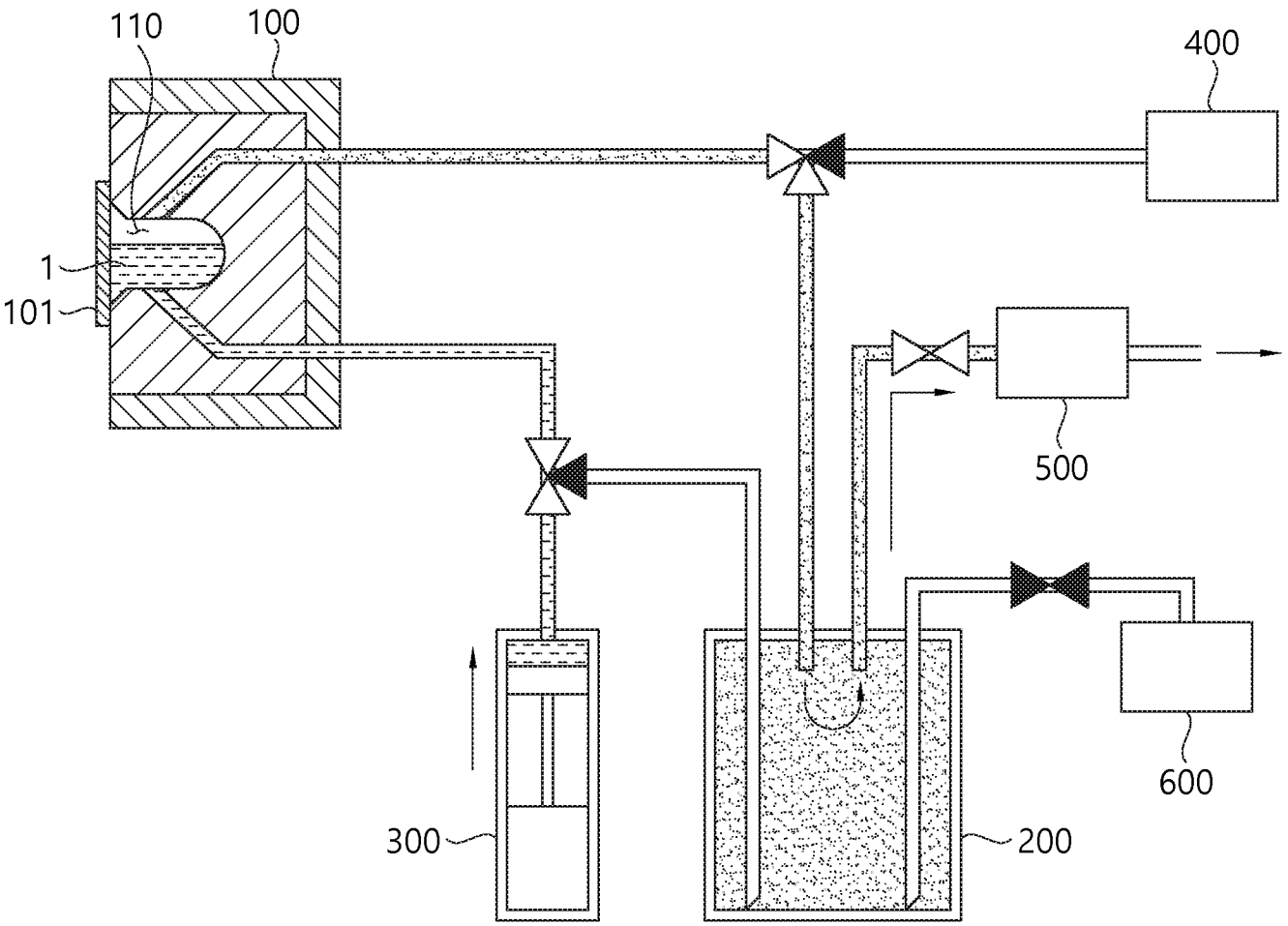
FIG. 5 is the other conceptual diagram illustrating the loading step.

FIG. 4 and FIG. 5 are conceptual diagrams illustrating a loading step. As illustrated in FIG. 4, the loading step comprises receiving the liquefied radium 1 by allowing the syringe pump 300 to suck a fixed quantity of liquefied radium 1 contained in the vial 200. At this time, quantity of the liquefied radium 1 sucked by the syringe pump 300 may be determined by considering quantity of the liquefied radium 1 contained in the chamber 100 and quantity of the liquefied radium 1 which is stagnant in a flow path from the syringe pump 300 to the chamber 100. As illustrated in FIG. 5, the liquefied radium 1 is loaded in the chamber 100 after the liquefied radium 1 is moved along the flow path when the liquefied radium 1 is extruded by the syringe pump 300. Further, according as the liquefied radium 1 is contained in the chamber 100, a gas containing radon is moved to the vial through an upper flow path in FIG. 5, the gas containing radon is discharged through a flow path provided in one side of the vial such that the gas containing radon passes through the radon collection unit 500, and radon can be collected in the radon collection unit 500.

Figure 6:
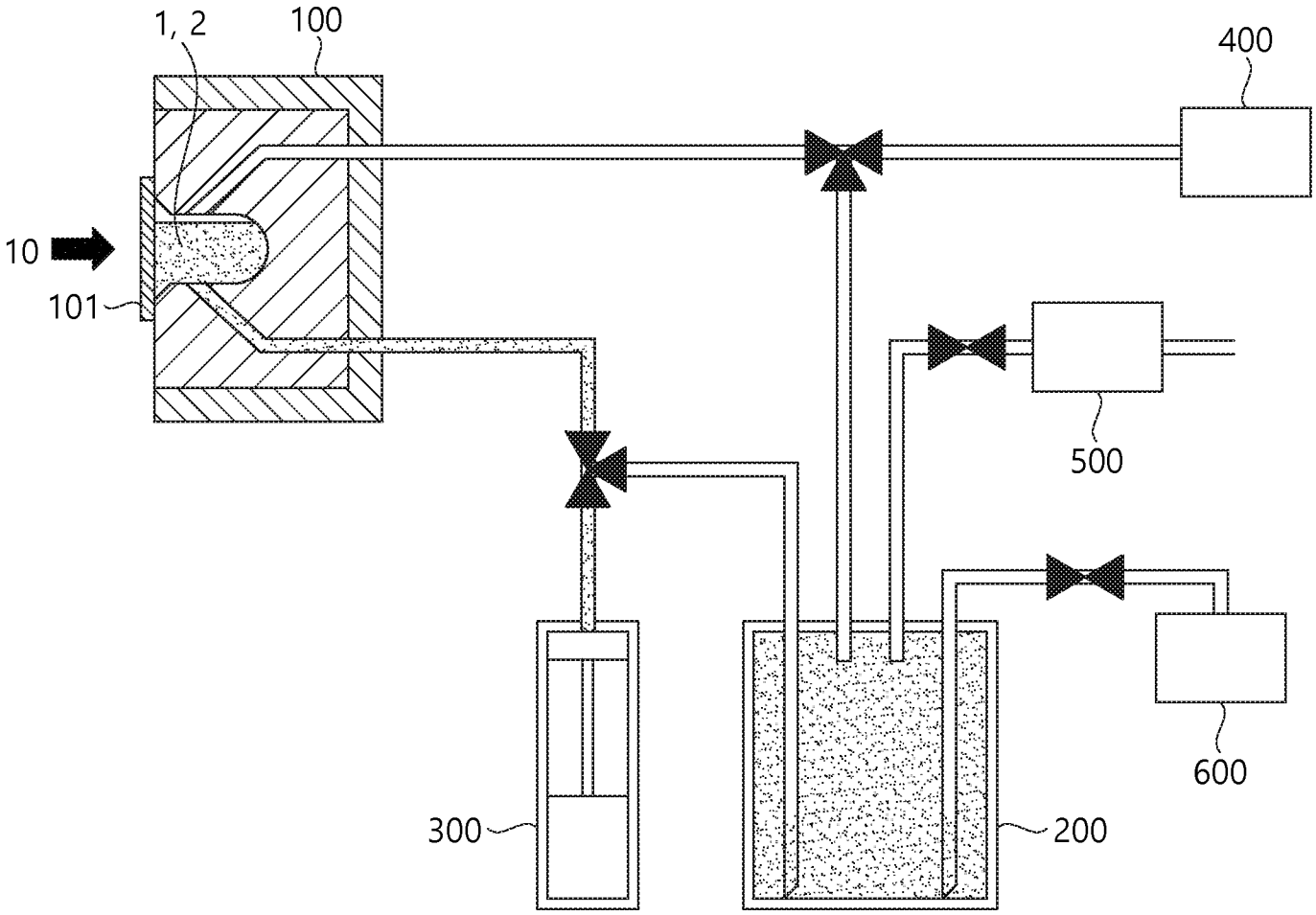
FIG. 6 is a conceptual diagram illustrating a step of producing actinium.

FIG. 6 is a conceptual diagram illustrating a step of producing actinium. A valve between the syringe pump 300 and the chamber 100 may be closed to prevent movement of the liquefied radium 1 when the liquefied radium 1 is loaded in the chamber 100. Further, a valve between the chamber 100 and the helium source 400 may be closed to prevent backflow of a radioactive material due to pressure increased during a nuclear reaction process. Thereafter, the nuclear reaction process is performed by irradiating a particle beam to the reaction space 110. Meanwhile, when the valve between the helium source 400 and the chamber 100 is opened, the helium source is operated to enable pressure inside the reaction space 110 to be maintained.

Figure 7:
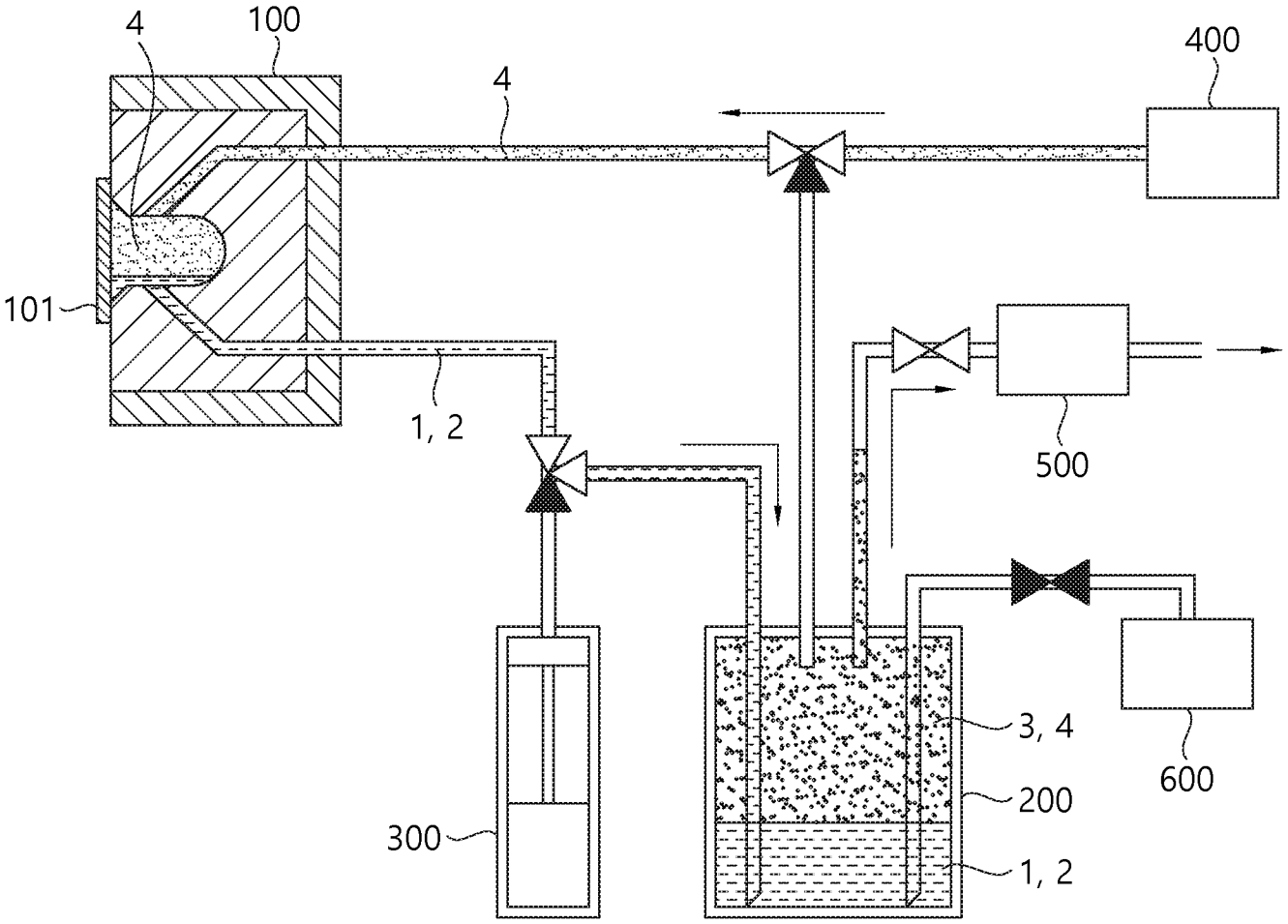
FIG. 7 is a conceptual diagram illustrating an unloading step.

FIG. 7 is a conceptual diagram illustrating an unloading step. When performing an unloading process, a valve is operated to open a flow path facing the vial 200 from the reaction space 110, and a product is moved to the vial 200 by blowing a helium gas 4 into the reaction space 110. At this time, it is preferable to blow a sufficient amount of helium into the reaction space 110 such that the product is not remained in the reaction space 110 and a flow path from the reaction space 110 to the vial 200. On the other hand, the helium gas 4 is flown in the reaction space 110 through a flow path connected to an upper side of the reaction space 110, and the liquefied radium 1 can be moved through a flow path connected to a lower side of the reaction space 110. Accordingly, when blowing the helium gas 4 into the reaction space 110, a product of a liquefied state can be naturally discharged from the lower side of the reaction space 110 to the outside of the chamber 100.

Figure 8:
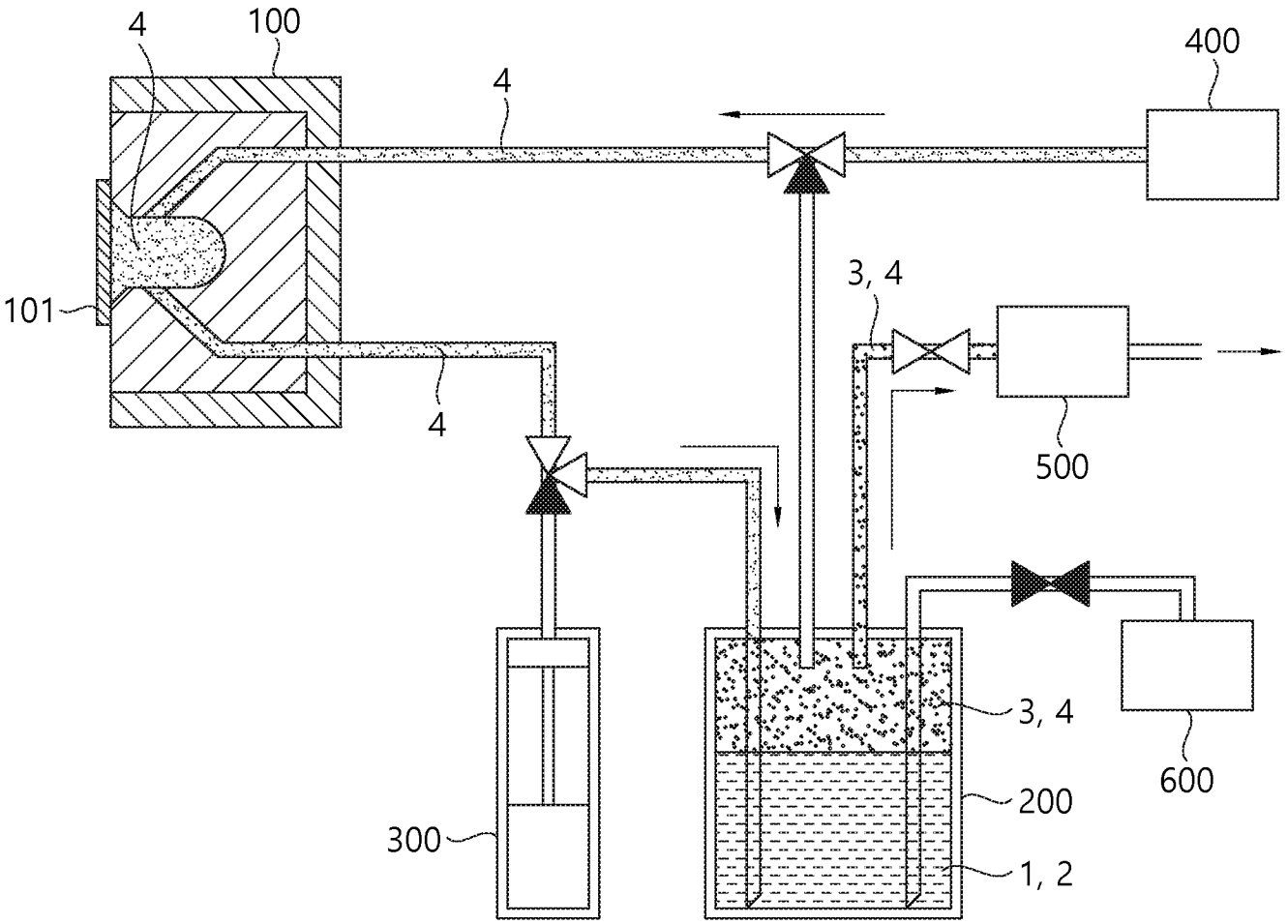
FIG. 8 is a conceptual diagram illustrating a step of discharging radon when performing the unloading step.

FIG. 8 is a conceptual diagram illustrating a step of discharging radon 3 when performing the unloading step.

As illustrated in FIG. 8, according as a liquefied product is flown in the vial while performing the unloading step, gas within the vial 200 is discharged along a flow path such that the gas within the vial 200 discharged along the flow path passes through the radon collection unit 500. Thereafter, the radon collection unit 500 collects the gas of radon 3 only from gas mixed together with a helium gas 4 and gas of radon 3, and discharges a remaining gas to the outside. When radon is collected, the collected radon may be disposed as radioactive waste in a liquefied state as described above. Further, although it has not been illustrated in FIG. 8, when the radon collection unit 500 is not provided, radon is stored for a predetermined time, or is diluted with a sufficient amount of air to enable the diluted radon to be discharged to the outside.

Figure 9:
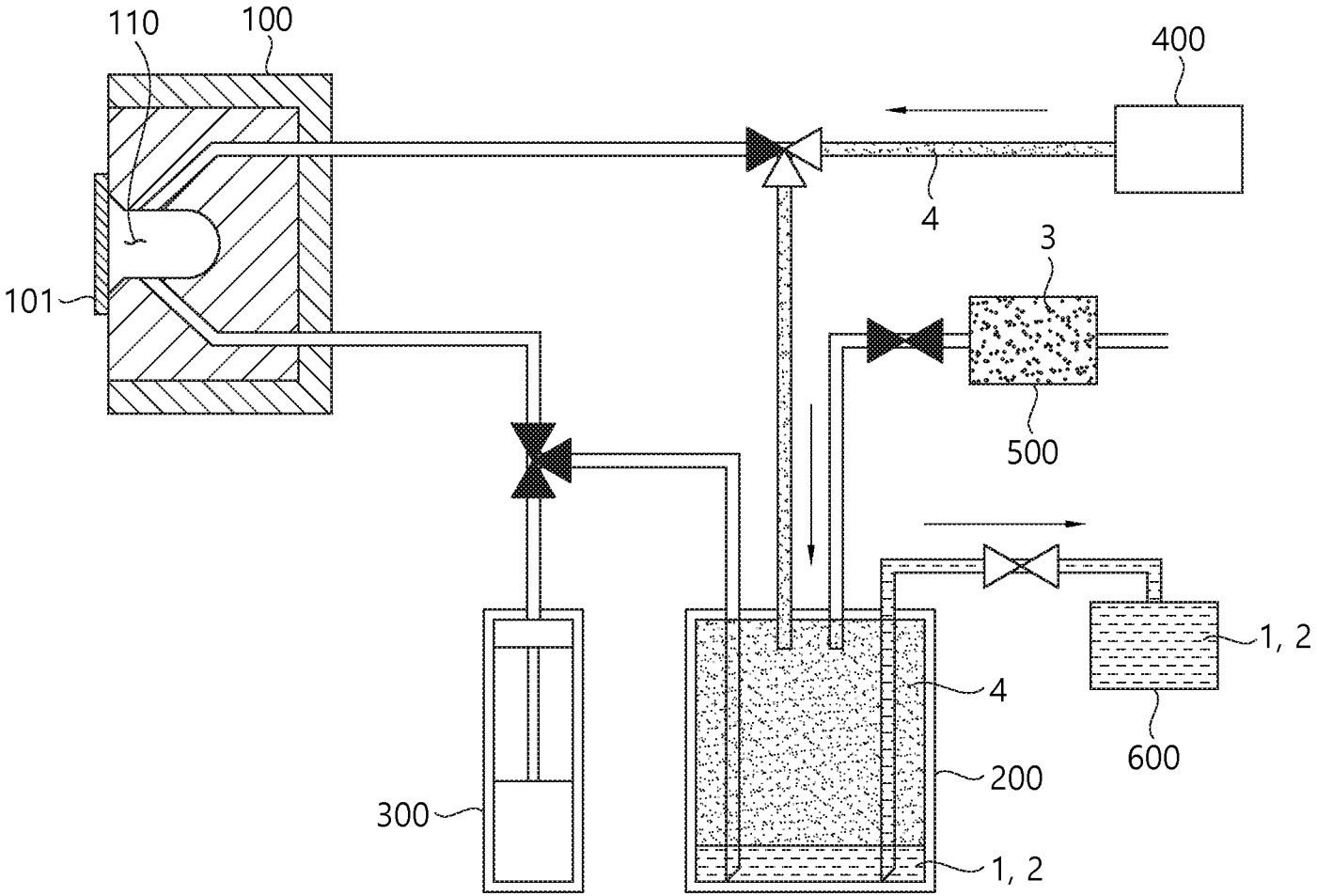
FIG. 9 is a conceptual diagram illustrating a step of moving a product to separate and refine actinium.

FIG. 9 is a conceptual diagram illustrating a step of transferring a liquefied product to separate and refine actinium. As illustrated in FIG. 9, the liquefied product is transferred from the vial to a space for refinement and separation to separate and refine actinium. Specifically, the product is transferred to the actinium separating and refining unit 600 by opening only a flow path between the vial 200 and the actinium separating and refining unit 600 and blowing the helium gas 4 into the vial 200. The liquefied radium 1 and the liquefied actinium 2 may be separated from each other in the actinium separating and refining unit 600. Refinement of actinium comprises performing an appropriate refinement process comprising removing impurities from the separated actinium such that the separated actinium can be used for medical purposes after transferring separated actinium.

Figure 10:
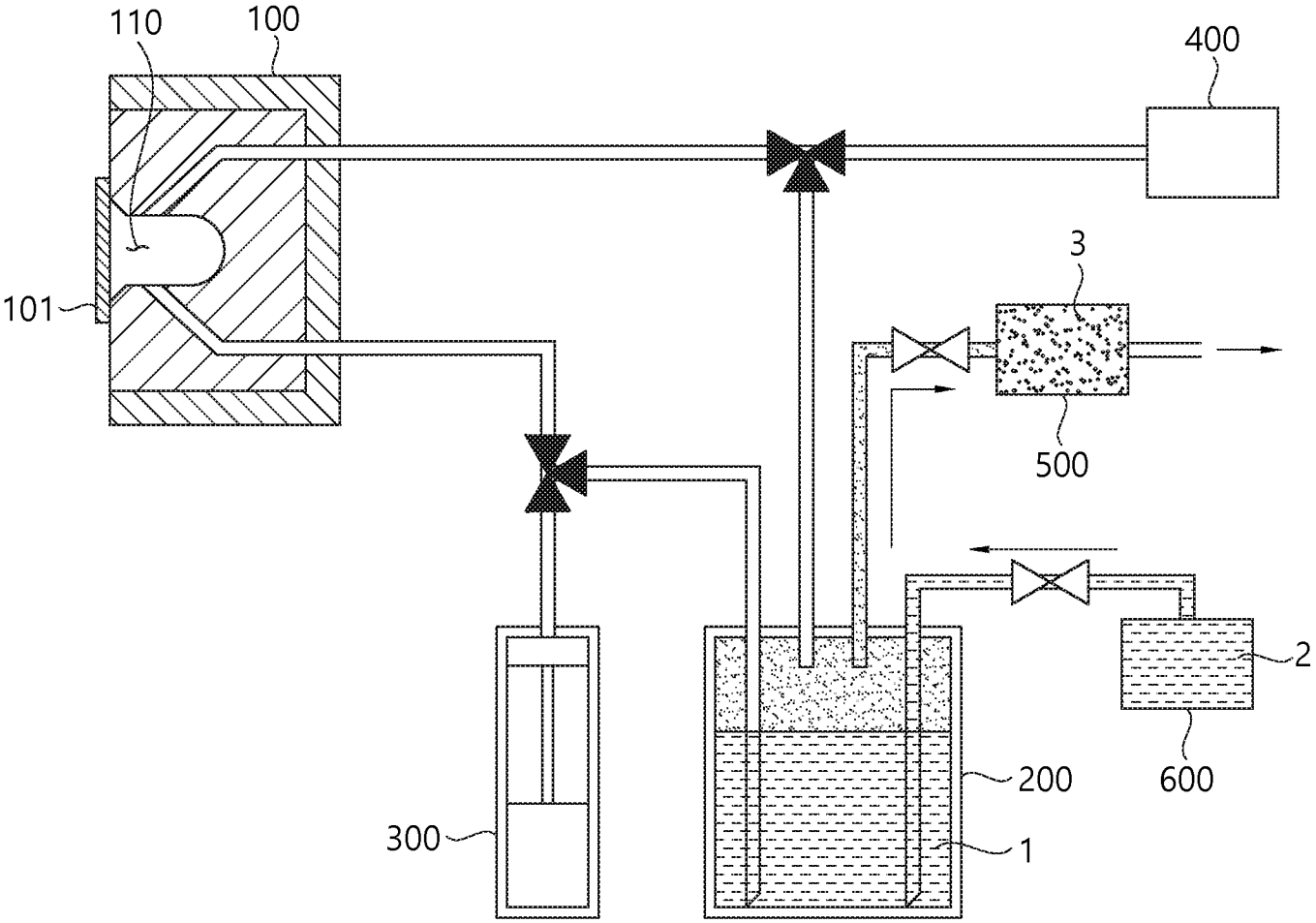
FIG. 10 illustrates a figure of moving liquefied radium before performing a reloading step.

FIG. 10 illustrates a figure of moving liquefied radium 1 before performing a reloading step. After disposing remaining liquefied radium 1 having the liquefied actinium 2 separated therefrom into pure liquefied radium through a refinement process, and concentrating liquid increased in the process of separating radium from actinium to prepare a preset fixed quantity of radium, the preset fixed quantity of radium is transferred to the vial 200 again. Thereafter, the processes can be repeatedly performed by starting a production process from the loading step. Meanwhile, the reloading process may be configured such that, when the pure liquefied radium is loaded into the vial in the reloading step, gas is discharged to the outside according to pressure increased inside a flow path in a manner similar to those of the loading step and the unloading step. Therefore, according as fluid is flown in the loading, unloading and reloading steps, radon is naturally discharged from the vial. The pure liquefied radium can be transferred using the helium gas during the reloading process. However, a method of transferring the pure liquefied radium is an example only, the pure liquefied radium may be transferred by various methods in addition to a method of using the helium gas.

As illustrate above, a method of producing actinium by using liquefied radium according to the present disclosure can minimize loss of radium by producing actinium through a nuclear reaction process using radium of a liquefied state, and performing the nuclear reaction process by circulating radium in a liquefied state without performing a separate chemical change in a repeated production process.

Further, a method of producing actinium by using liquefied radium according to the present disclosure has an effect of enabling safety to be improved by discharging radon generated during handling of radon, thereby preventing exposure to radiation due to radon gas.

What is claimed is:

1. A method of producing actinium by using liquefied radium, the method comprising:

a loading step of moving the liquefied radium from a vial to load the liquefied radium into a reaction space inside a chamber;

a step of producing actinium through a nuclear reaction process by irradiating a particle beam to the liquefied radium in the reaction space inside the chamber; and an unloading step of moving a product comprising the liquefied radium and actinium to the vial, wherein, when the liquefied radium is loaded into the reaction space inside the chamber, a gas containing radon is moved to the vial through a first flow path connected to an upper side of the reaction space, and the moved gas is discharged from the vial through a second flow path.

2. The method of claim 1, further comprising step of separating actinium from the product.

3. The method of claim 2, further comprising a reloading step of transferring pure liquefied radium obtained by separating actinium from the product to the reaction space of the chamber.

4. The method of claim 2, further comprising condensing radon to discard radon.

5. The method of claim 2, further comprising diluting radon with external air to discharge the diluted radon.

6. The method of claim 2, wherein the loading step comprises moving a preset amount of radium to the reaction space.

7. The method of claim 6, wherein the loading step comprises moving the preset amount of radium to the reaction space by using a syringe pump.

8. The method of claim 2, wherein the unloading step comprises unloading the product by flowing in an inert gas into the reaction space of the chamber.

9. The method of claim 2, wherein the radium is liquefied by using an organic solution.

10. The method of claim 9, wherein the organic solution includes $NO_3$ or $Cl_2$.

11. The method of claim 2, further comprising a step of refining the separated actinium.

12. The method of claim 7, wherein the preset amount of radium from the syringe pump moves to the reaction space through a third flow path, and the product comprising the liquefied radium and actinium moves from the reaction space to the vial through a fourth flow path, both of the third flow path and the fourth flow path including a flow path connected to a lower side of the reaction space.

13. The method of claim 1, further comprising:

a step of transferring the product along a third flow path from the vial to an actinium separating and refining unit.

14. The method of claim 1, wherein, while performing the unloading step, a gas within the vial is discharged along the second flow path coupled between the vial and a radon collection unit.

* * * * *